US007154467B2

(12) United States Patent
Kojima et al.

(10) Patent No.: US 7,154,467 B2
(45) Date of Patent: Dec. 26, 2006

(54) CONTROL CIRCUIT OF LIQUID CRYSTAL DISPLAY DEVICE FOR PERFORMING DRIVING COMPENSATION

(75) Inventors: Toshihiro Kojima, Kawasaki (JP); Koichi Katagawa, Kawasaki (JP); Mikio Oshiro, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 478 days.

(21) Appl. No.: 10/806,071

(22) Filed: Mar. 22, 2004

(65) Prior Publication Data

US 2004/0218134 A1 Nov. 4, 2004

(30) Foreign Application Priority Data

Mar. 28, 2003 (JP) ..... 2003-090371

(51) Int. Cl.
*G09G 3/36* (2006.01)

(52) U.S. Cl. ..... 345/100; 345/89; 345/98

(58) Field of Classification Search ..... 345/87, 345/89, 98–100, 204, 690
See application file for complete search history.

(56) References Cited

U.S. PATENT DOCUMENTS 6,833,886 B1 * 12/2004 Suzuki et al. ..... 349/87
2003/0179170 A1 * 9/2003 Lee ..... 345/87
2004/0041767 A1 * 3/2004 Sugino ..... 345/89
2004/0135800 A1 * 7/2004 Shiomi et al. ..... 345/691

FOREIGN PATENT DOCUMENTS

| | | |
|---|---|---|
| JP | 2002-062850 | 2/2002 |
| JP | 2002-202763 | 7/2002 |
| JP | 2002-297104 | 10/2002 |

* cited by examiner

*Primary Examiner*—Jimmy H. Nguyen
(74) *Attorney, Agent, or Firm*—Greer, Burns & Crain, Ltd

(57) ABSTRACT

A control circuit of a liquid crystal display device has a display driving data generation section. The display driving data generation section includes a conversion table 46 for storing compensation data corresponding to the combination of the significant bits of the image data nFi of the current frame and of the post driving status data (n−1)Fp of the previous frame, and an interpolation operation section for generating interpolation compensation data by performing an interpolation operation for the compensation data which is read from the conversion table according to the insignificant bits of the image data of the current frame and of the post driving status data of the previous frame. And the conversion table further comprises a singular point conversion table used when the post driving status data of the previous frame is a first data. These tables are selected depending on whether the post driving status data of the previous frame is the first data or not.

12 Claims, 9 Drawing Sheets

BLOCK DIAGRAM

BLOCK DIAGRAM

FIRST EMBODIMENT

FIG. 4A 4b

COMPENSATION VALUE 60Hz Ta =20℃

| START POINT GRAY SCALE | END POINT GRAY SCALE (IMAGE DATA OF CURRENT FRAME) | | | | | | | | | | | | | | | | |
|---|---|---|---|---|---|---|---|---|---|---|---|---|---|---|---|---|---|
| | 0/255 | 16/255 | 32/255 | 48/255 | 64/255 | 80/255 | 96/255 | 112/255 | 128/255 | 144/255 | 160/255 | 176/255 | 192/255 | 208/255 | 224/255 | 240/255 | 255/255 |
| 0/255 | — | 10 | 19 | 29 | 32 | 31 | 29 | 27 | 24 | 21 | 18 | 15 | 13 | 10 | 7 | 3 | 0 |
| 16/255 | 0 | — | 7 | 17 | 24 | 25 | 24 | 22 | 20 | 18 | 15 | 13 | 11 | 9 | 7 | 3 | 0 |
| 32/255 | 0 | -3 | — | 9 | 16 | 19 | 20 | 19 | 17 | 15 | 13 | 11 | 10 | 8 | 6 | 3 | 0 |
| 48/255 | 0 | -3 | -6 | — | 7 | 11 | 14 | 14 | 15 | 12 | 11 | 10 | 8 | 7 | 5 | 3 | 0 |
| 64/255 | 0 | -4 | -7 | -6 | — | 4 | 8 | 10 | 10 | 10 | 9 | 8 | 7 | 6 | 5 | 3 | 0 |
| 80/255 | 0 | -4 | -7 | -8 | -4 | — | 4 | 6 | 8 | 8 | 7 | 6 | 6 | 5 | 4 | 3 | 0 |
| 96/255 | 0 | -4 | -7 | -10 | -7 | -4 | — | 3 | 5 | 6 | 6 | 5 | 5 | 5 | 4 | 3 | 0 |
| 112/255 | 0 | -4 | -7 | -11 | -9 | -6 | -3 | — | 3 | 4 | 4 | 4 | 4 | 4 | 3 | 3 | 0 |
| 128/255 | 0 | -4 | -7 | -11 | -11 | -8 | -5 | -3 | — | 2 | 3 | 3 | 3 | 3 | 3 | 2 | 0 |
| 144/255 | 0 | -4 | -8 | -11 | -12 | -10 | -7 | -5 | -2 | — | 2 | 3 | 3 | 3 | 3 | 2 | 0 |
| 160/255 | 0 | -4 | -8 | -11 | -14 | -12 | -9 | -7 | -4 | -2 | — | 2 | 2 | 2 | 2 | 2 | 0 |
| 176/255 | 0 | -4 | -8 | -11 | -14 | -14 | -11 | -9 | -6 | -4 | -2 | — | 1 | 2 | 2 | 2 | 0 |
| 192/255 | 0 | -4 | -8 | -11 | -15 | -15 | -13 | -11 | -9 | -6 | -4 | -2 | — | 1 | 1 | 2 | 0 |
| 208/255 | 0 | -4 | -8 | -11 | -15 | -17 | -15 | -14 | -11 | -9 | -6 | -3 | -1 | — | 1 | 1 | 0 |
| 224/255 | 0 | -4 | -8 | -12 | -15 | -18 | -18 | -16 | -14 | -12 | -9 | -5 | -2 | -1 | — | 1 | 0 |
| 240/255 | 0 | -4 | -8 | -12 | -15 | -19 | -20 | -19 | -17 | -15 | -12 | -7 | -4 | -2 | -1 | — | 0 |
| 255/255 | 0 | -4 | -8 | -12 | -15 | -19 | -22 | -22 | -20 | -19 | -15 | -10 | -6 | -4 | -2 | -1 | — |

FIG. 4B 4b2

COMPENSATION VALUE 60Hz TA=20℃ COMPENSATION VALUE TABLE (ORDINARY POINTS)

| START POINT GRAY SCALE | END POINT GRAY SCALE (IMAGE DATA OF CURRENT FRAME) | | | | | | | | | | | | | | | | |
|---|---|---|---|---|---|---|---|---|---|---|---|---|---|---|---|---|---|
| | 0/255 | 16/255 | 32/255 | 48/255 | 64/255 | 80/255 | 96/255 | 112/255 | 128/255 | 144/255 | 160/255 | 176/255 | 192/255 | 208/255 | 224/255 | 240/255 | 255/255 |
| 2/255 | — | 8 | 15 | 26 | 30 | 29 | 28 | 25 | 23 | 20 | 17 | 14 | 11 | 9 | 7 | 3 | 0 |
| 16/255 | 0 | — | 7 | 17 | 24 | 25 | 24 | 22 | 20 | 18 | 15 | 13 | 11 | 9 | 7 | 3 | 0 |
| 32/255 | 0 | -3 | — | 9 | 16 | 19 | 20 | 19 | 17 | 15 | 13 | 11 | 10 | 8 | 6 | 3 | 0 |
| 48/255 | 0 | -3 | -6 | — | 7 | 11 | 14 | 14 | 15 | 12 | 11 | 10 | 8 | 7 | 5 | 3 | 0 |
| 64/255 | 0 | -4 | -7 | -6 | — | 4 | 8 | 10 | 10 | 10 | 9 | 8 | 7 | 6 | 5 | 3 | 0 |
| 80/255 | 0 | -4 | -7 | -8 | -4 | — | 4 | 6 | 8 | 8 | 7 | 6 | 6 | 5 | 4 | 3 | 0 |
| 96/255 | 0 | -4 | -7 | -10 | -7 | -4 | — | 3 | 5 | 6 | 6 | 5 | 5 | 5 | 4 | 3 | 0 |
| 112/255 | 0 | -4 | -7 | -11 | -9 | -6 | -3 | — | 3 | 4 | 4 | 4 | 4 | 4 | 3 | 3 | 0 |
| 128/255 | 0 | -4 | -7 | -11 | -11 | -8 | -5 | -3 | — | 2 | 3 | 3 | 3 | 3 | 3 | 2 | 0 |
| 144/255 | 0 | -4 | -8 | -11 | -12 | -10 | -7 | -5 | -2 | — | 2 | 3 | 3 | 3 | 3 | 2 | 0 |
| 160/255 | 0 | -4 | -8 | -11 | -14 | -12 | -9 | -7 | -4 | -2 | — | 2 | 2 | 2 | 2 | 2 | 0 |
| 176/255 | 0 | -4 | -8 | -11 | -14 | -14 | -11 | -9 | -6 | -4 | -2 | — | 1 | 2 | 2 | 2 | 0 |
| 192/255 | 0 | -4 | -8 | -11 | -15 | -15 | -13 | -11 | -9 | -6 | -4 | -2 | — | 1 | 1 | 2 | 0 |
| 208/255 | 0 | -4 | -8 | -11 | -15 | -17 | -15 | -14 | -11 | -9 | -6 | -3 | -1 | — | 1 | 1 | 0 |
| 224/255 | 0 | -4 | -8 | -12 | -15 | -18 | -18 | -16 | -14 | -12 | -9 | -5 | -2 | -1 | — | 1 | 0 |
| 240/255 | 0 | -4 | -8 | -12 | -15 | -19 | -20 | -19 | -17 | -15 | -12 | -7 | -4 | -2 | -1 | — | 0 |
| 255/255 | 0 | -4 | -8 | -12 | -15 | -19 | -22 | -22 | -20 | -19 | -15 | -10 | -6 | -4 | -2 | -1 | — |

FIG. 4C 4b1

COMPENSATION VALUE TABLE (SINGULAR POINTS)

| START POINT GRAY SCALE | END POINT GRAY SCALE (IMAGE DATA OF CURRENT FRAME) | | | | | | | | | | | | | | | | |
|---|---|---|---|---|---|---|---|---|---|---|---|---|---|---|---|---|---|
| | 0/255 | 16/255 | 32/255 | 48/255 | 64/255 | 80/255 | 96/255 | 112/255 | 128/255 | 144/255 | 160/255 | 176/255 | 192/255 | 208/255 | 224/255 | 240/255 | 255/255 |
| 0/255 | 0 | 10 | 19 | 29 | 32 | 31 | 29 | 27 | 24 | 21 | 18 | 15 | 13 | 10 | 7 | 3 | 0 |

FIG. 5
4b2
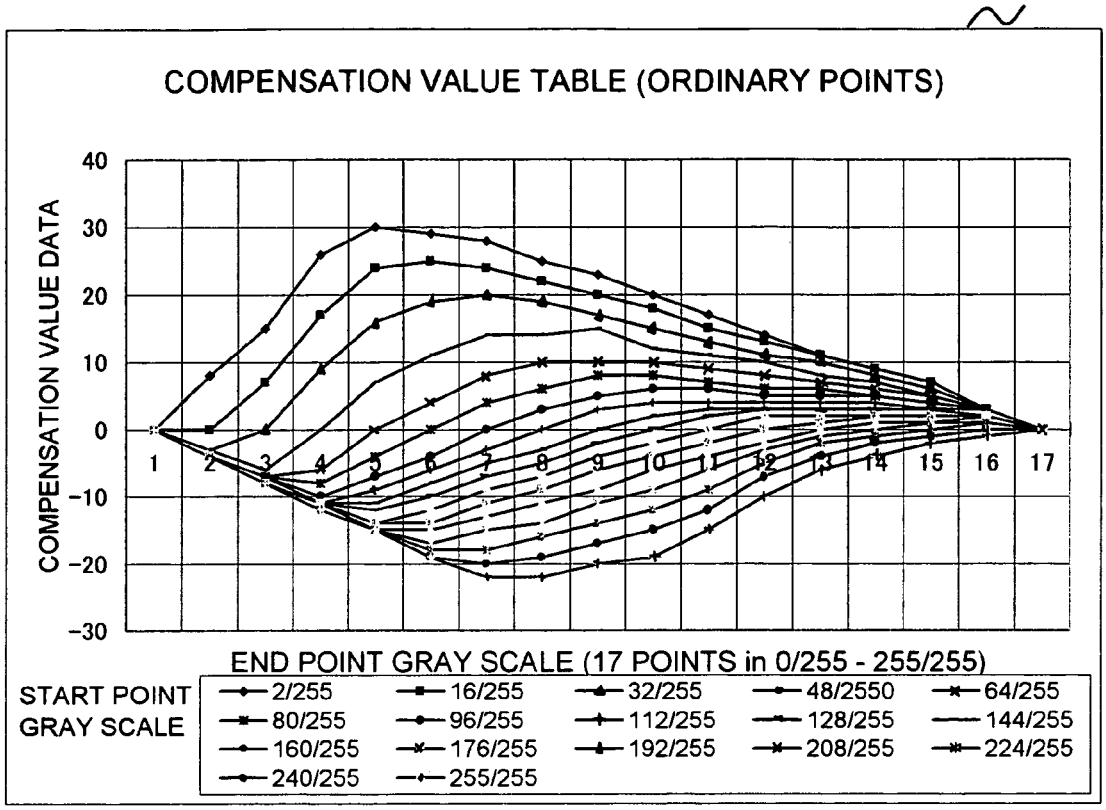
4b1
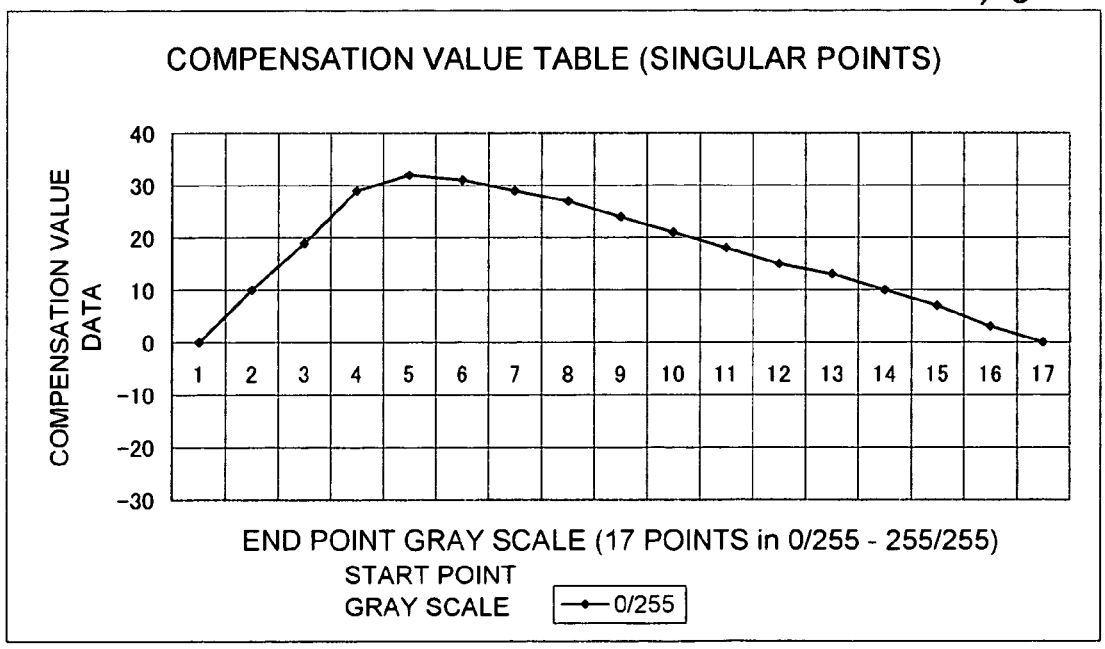

SECOND EMBODIMENT

FIG. 7A 4d2

EQUAL DIVISION INTERPOLATION (STANDARD INTERPOLATION FORMULA)

←EQUAL DIVISION INTERPOLATION→

| | | | | |
|---|---|---|---|---|
| A11 | (3*A11+A12)/4 | (A11+A12)/2 | (A11+3*A12)/4 | A12 |
| (3*A11+A21)/4 | (9*A11+3*A12+3*A21+A22)/16 | (3*A11+3*A12+A21+A22)/8 | (3*A11+9*A12+A21+3*A22)/16 | (3*A12+A22)/4 |
| (A11+A21)/2 | (3*A11+A12+3*A21+A22)/8 | (A11+A12+A21+A22)/4 | (A11+3*A12+A21+3*A22)/8 | (A12+A22)/2 |
| (A11+3*A21)/4 | (3*A11+A12+9*A21+3*A22)/16 | (A11+A12+3*A21+3*A22)/8 | (A11+3*A12+3*A21+9*A22)/16 | (A12+3*A22)/4 |
| A21 | (3*A21+A22)/4 | (A21+A22)/2 | (A21+3*A22)/4 | A22 |

↑ EQUAL DIVISION INETRPOLATION ↓

DIVIDES VERTICAL DIRECTION OF TABLE INTO 1:1:1:1
HORIZONTAL DIRECTION INTO 1:1:1:1

FIG. 7B 4d1

UNEQUAL DIVISION INTERPOLATION EXAMPLE (SINGULAR POINT AREA INTERPOLATION FORMULA)

←EQUAL DIVISION INTERPLOATION→

| | | | | |
|---|---|---|---|---|
| A11 | (3*A11+A12)/4 | (A11+A12)/2 | (A11+3*A12)/4 | A12 |
| (A11+A21)/2 | (3*A11+A12+3*A21+A22)/8 | (A11+A12+A21+A22)/4 | (A11+3*A12+A21+3*A22)/8 | (A12+A22)/2 |
| (A11+3*A21)/4 | (3*A11+A12+9*A21+3*A22)/16 | (A11+A12+3*A21+3*A22)/8 | (A11+3*A12+3*A21+9*A22)/16 | (A12+3*A22)/4 |
| (A11+7*A21)/8 | (3*A11+A12+21*A21+7*A22)/32 | (A11+A12+7*A21+7*A22)/16 | (A11+3*A12+7*A21+21*A22)/32 | (A12+7*A22)/8 |
| A21 | (3*A21+A22)/4 | (A21+A22)/2 | (A21+3*A22)/4 | A22 |

↑ UNEQUAL DIVISION INETRPOLATION ↓

DIVIDES VERTICAL DIRECTION OF TABLE INTO 4:2:1:1
HORIZONTAL DIRECTION INTO 1:1:1:1

SECOND EMBODIMENT (VARIANT FORM)

THIRD EMBODIMENT

FREQUENCY INTERPOLATION OPERATION EXAMPLE

| F | 50Hz | 51-57 , | 58-65 , | 66-72 , | 73Hz |
|---|---|---|---|---|---|
| COMPENSATION VALUE | A | (3A+B)/4 | (A+B)/2 | (A+3B)/4 | B |

CONTROL CIRCUIT OF LIQUID CRYSTAL DISPLAY DEVICE FOR PERFORMING DRIVING COMPENSATION

CROSS-REFERENCE TO RELATED APPLICATIONS

This application is based upon and claims the benefit of priority from the prior Japanese Patent Application No. 2003-090371, filed on Mar. 28, 2003, the entire contents of which are incorporated herein by reference.

BACKGROUND OF THE INVENTION

1. Field of the Invention

The present invention relates to a control circuit of a liquid crystal display device, and more particularly to a control circuit of a liquid crystal display device which allows high-speed response by adding a compensation value to the driving voltage of a cell so as to compensate driving, and which allows a more accurate driving compensation by changing the compensation value conversion table depending on the status of the previous frame.

2. Description of the Related Art

Liquid crystal display devices are widely used as energy saving and space saving display devices. Recently, liquid crystal displays are also receiving attention as display devices for TVs, which displays moving pictures. A liquid crystal display panel is comprised of source electrodes to which a display driving voltage corresponding to the image data of the current frame is applied, gate electrodes which are driven at the scanning timing, and cell transistors and pixel electrodes which are disposed at positions where the source electrodes and the gate electrodes cross each other, wherein desired images are displayed by applying the display driving voltage to the liquid crystal layer between the pixel electrodes via the cell transistors, changing the transmittance of the liquid crystal layer.

Generally speaking, liquid crystal materials have poor response characteristics, and in some cases it is difficult to change to a status corresponding to the input gray scale data within one frame period, and these poor response characteristics cause a drop in the image quality of a moving picture display. To solve these slow response characteristics, a driving compensation method has been proposed (e.g. Japanese Patent Application Laid-Open No. 2002-297104 (corresponding to the U.S. published Unexamined Patent Application US-2002-0140652-A1), Japanese Patent Application Laid-Open No. 2002-6285 and Japanese Patent Application Laid-Open No. 2002-202763).

Japanese Patent Application Laid-Open No. 2002-297104 discloses that the display driving data for the image data of the current frame is determined by adding or subtracting (hereafter referred to as "adding") the compensation value according to the combination of the post driving status data of the previous frame and the image data of the current frame to/from the image data of the current frame. Even if the liquid crystal layer is driven with the display driving voltage corresponding to the display driving data, the liquid crystal layer does not always become the status of the display driving data within a flame period, so the differential value corresponding to the combination of the post driving status data of the previous frame and the input gray scale data in the current frame is added to or subtracted from (hereafter referred to as "added") the image data of the current frame, to determine the post driving status data, which is stored in the frame memory.

Japanese Patent Application Laid-Open No. 2002-297104 also discloses that in order to decrease the data capacity of the conversion table for determining the compensation values and the differential values, compensation values and differential values are stored for the combination of significant bits of the post driving status data of the previous frame and the image data of the current frame, and an interpolation operation is performed by insignificant bits.

SUMMARY OF THE INVENTION

However, the characteristic curves of the compensation values differ greatly between the case when the post driving status of the previous frame is gray scale "0", and the case when the gray scale is not "0", and if the same linear interpolation operation is performed for all cases, correct compensation values are not always determined.

FIG. 1 is a graph depicting the relationship between the post driving status of the previous frame and the compensation value. The abscissa indicates the start point gray scale which indicates the post driving status of the previous frame, and the ordinate indicates the compensation value, and the characteristic curve in FIG. 1 is the case when the end point gray scale, which indicates the image data of the current frame, is 48/256 (48 out of a 256 gray scale). When the start point gray scale of the previous frame is "0", the compensation value is large, "29", but if the start point gray scale is more than "0", the compensation value suddenly drops, and when the start point gray scale becomes larger than "2" for example, the compensation value changes almost linearly. And in the area where the start point gray scale exceeds "16", the compensation value decreases quite linearly.

Because of this characteristic, if a linear interpolation operation is performed for the two points C (0) and C (16) when the start point gray scale is between 0/255 and 16/255, the compensation values indicated by the broken line, which is different from the actual characteristic curve, are determined. Specifically, if the start point gray scale is 8/255, the correction values become excessive for the amount of dx in FIG. 1. Along with this, if the values, which is the compensation values determined by the linear interpolation operation plus the image data of the current frame, are used for the display driving data, appropriate driving compensation cannot be executed. If the compensation value data for all start point gray scales is stored in the conversion table, compensation values according to the actual characteristic curve can be generated, but this makes the data capacity of the conversion table enormous, and increases cost.

Another problem is that liquid crystal display devices are demanded to control displays according to different frame frequencies, since the frame frequency can be freely set in the host computer which is connected to the liquid crystal display device. However, in the case of a conventional driving compensation method, a same driving compensation table is used regardless the frequency, where the same driving compensation is performed whether the frame period is long or short. Therefore when the frame period is short, compensation tends to be insufficient, and when the frame period is long, compensation tends to be excessive. As a result, an appropriate driving compensation is not executed.

With the foregoing in view, it is an object of the present invention to provide a control circuit for the liquid crystal display device which performs appropriate driving compensation.

To achieve the above object, a first aspect of the present invention is a control circuit of a liquid crystal display device comprising a display driving data generation section for generating display driving data corresponding to the combination of image data of the current frame and post driving status data of the previous frame, wherein the display driving data generation section further comprises a conversion table for storing compensation data or compensation display driving data corresponding to the combination of the significant bits of the image data of the current frame and of the post driving status data of the previous frame, and an interpolation operation section for generating interpolation compensation data by performing an interpolation operation for the compensation data which is read from the conversion table according to the insignificant bits of the image data of the current frame and of the post driving status data of the previous frame. And the conversion table further comprises a singular point conversion table used when the post driving status data of the previous frame is a first data, and an ordinary point conversion table used when the post driving status data of the previous frame is other than the first data, and the display driving data generation section selects the singular point conversion table or the ordinary point conversion table depending on whether the post driving status data of the previous frame is the first data or not.

According to the first aspect of the present invention, the conversion table is divided into the singular point conversion table, used when the post driving status data of the previous frame is the first data, and the ordinary point conversion table, used when the post driving status data of the previous frame is other than the first data, and one of these two conversion tables is selected depending on the post driving status data of the previous frame. Therefore when the post driving status data of the previous frame is not a singular point but an ordinary point, the influence of characteristics at a singular point can be eliminated, and a more accurate correction data or corrected display driving data can be determined.

To achieve the above object, the second aspect of the present invention is a control circuit of a liquid crystal display device, comprising a display driving data generation section for generating display driving data corresponding to the combination of image data of the current frame and post driving status data of the previous frame, wherein the display driving data generation section further comprises a conversion table for storing compensation data or compensation display driving data corresponding to the combination of the significant bits of the image data of the current frame and of the post driving status data of the previous frame, and an interpolation operation section for generating interpolation compensation data or interpolation compensation display driving data by performing an interpolation operation for the compensation data or the compensation display driving data which is read from the conversion table according to the insignificant bits of the image data of the current frame and of the post driving status data of the previous frame. And the interpolation operation section further comprises a singular point interpolation operation unit used when the post driving status data of the previous frame is the first data, and an ordinary point interpolation operation unit used when the post driving status data of the previous frame is other than the first data, and the display driving data generation section selects the singular point interpolation operation unit or the ordinary point interpolation operation unit depending on whether the post driving status data of the previous frame is the first data or not.

According to the second aspect of the present invention, the interpolation operation section is divided into the singular point interpolation operation unit used when the post driving status data of the previous frame is the first data, and the ordinary point interpolation operation unit used when the post driving status data of the previous frame is other than the first data, and one of these two interpolation operation units is selected depending on the post driving status data of the previous frame. Therefore when the post driving status data of the previous frame is a singular point, the first interpolation operation, such as a non-linear interpolation operation, is used, and when the post driving status data of the previous frame is not a singular point but an ordinary point, the second interpolation operation, such as a linear interpolation operation, is used, so a more accurate correction data or a corrected display driving data can be determined.

By combining the first aspect and the second aspect of the present invention, a more accurate compensation data or compensation display driving data can be determined.

To achieve the above object, the third aspect of the present invention is a control circuit of a liquid crystal display device, comprising a display driving data generation section for generating display driving data corresponding to the combination of image data of the current frame and post driving status data of the previous frame, wherein this display driving data generation section further comprises a conversion table for storing the compensation data or the compensation display driving data corresponding to the combination of the image data of the current frame and the post driving status data of the previous frame, and this conversion table further includes a first conversion table corresponding to a first frame frequency and a second conversion table corresponding to a second frame frequency. The display driving data generation section further comprises an interpolation operation section for performing an interpolation operation (including extrapolation) for the compensation data or the compensation display driving data which is read from the first or second conversion table according to the current frame frequency, and generating the interpolation compensation data or the interpolation compensation display driving data.

According to the third aspect, the compensation data or the compensation display driving data, which is optimum for the frame frequency during driving, can be generated, so a more appropriate driving compensation can be performed.

BRIEF DESCRIPTION OF THE DRAWINGS

FIG. 4 are tables showing examples of the conversion table of correction values;

FIG. 5 are graphs depicting the ordinary point conversion table 4b2 in FIG. 4B and the singular point conversion table 4b1 in FIG. 4C;

FIG. 7 are tables showing examples of two interpolation operations according to the second embodiment;

DESCRIPTION OF THE PREFERRED EMBODIMENTS

Embodiments of the present invention will now be described with reference to the accompanying drawings. However the protective scope of the present invention is not limited to the embodiments herein below, but covers the inventions stated in the Claims and equivalents thereof.

Figure 2:
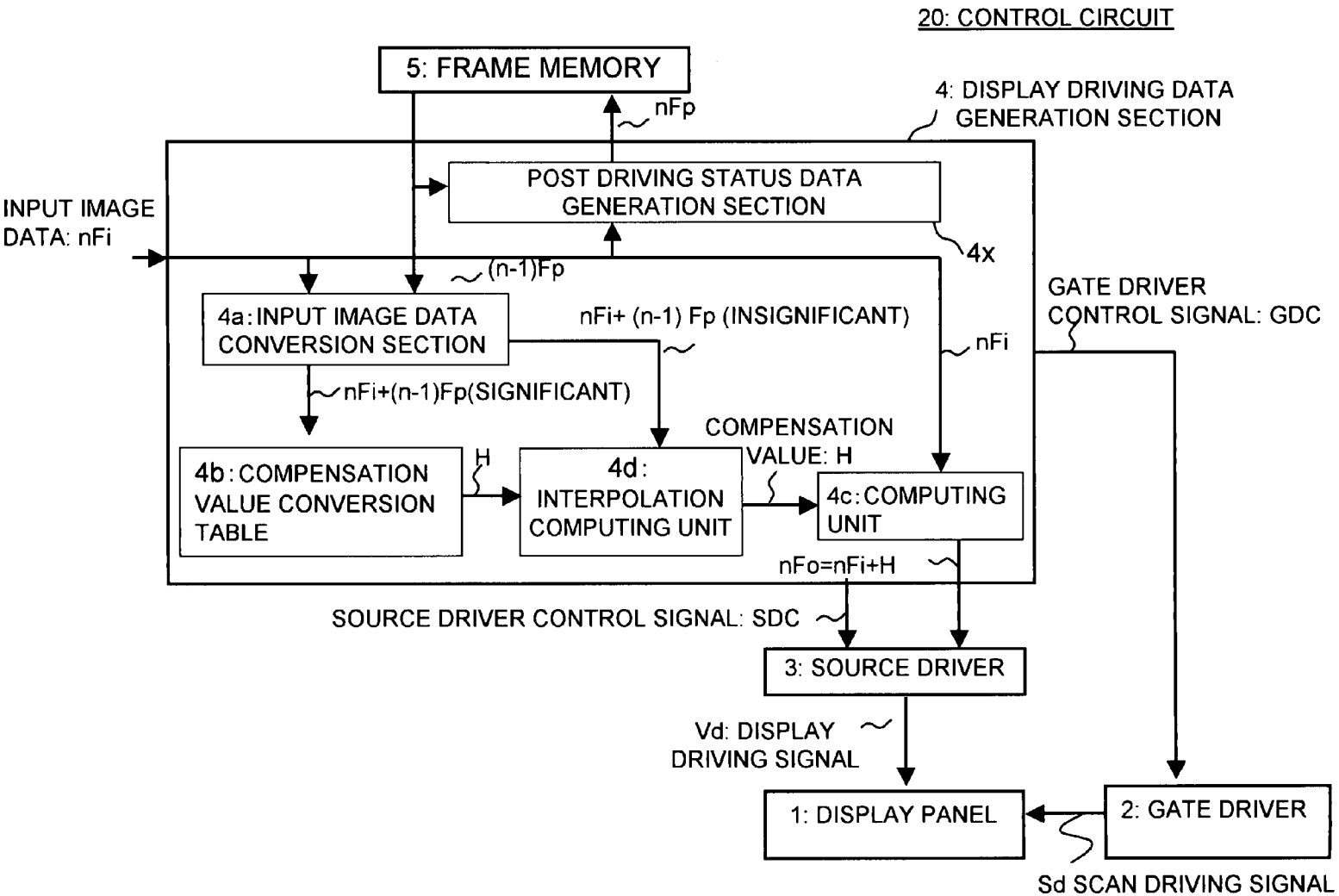
FIG. 2 is a block diagram depicting the liquid crystal display device.

FIG. 2 is a block diagram depicting the liquid crystal display device. In this configuration, the scan driving signal Sd of the gate driver 2 is supplied to the gate electrode line, which is not illustrated here, of the liquid crystal display panel 1, and the display driving signal Vd of the source driver 3 is supplied to the source electrode line, which is not illustrated here. The control circuit 20 is comprised of the display driving data generation section 4 for generating the display driving data nFo from the input image data nFi, a frame memory 5 for storing the post driving status data nFp and (n−1) Fp respectively of the current frame nF and the previous frame (n−1)F, and a circuit (not illustrated) for generating the gate driver control signal GDC and the source driver control signal SDC.

The image data to be displayed in the current frame is the current frame image data nFi, and the display driving data nFo (=nFi+H) of the current frame is generated by adding the compensation value H to the current frame image data nFi. In this case, however, the post driving status of the liquid crystal layer may not becomes a desired status even if driving is performed with the display driving data nFo, so the post driving status data nFp, which is distinguished from the current frame image data nFi, is generated in each frame, and is stored in the frame memory 5.

In the configuration in FIG. 2, the display driving data generation section 4 reads the compensation value H, which corresponds to the combination of the current frame image data nFi to be input and the post driving status data of the previous frame (n−1)Fp stored in the frame memory 5, from the compensation conversion table 4*b*. In order to decrease the data amount of the compensation conversion table 4*b*, the compensation value H, corresponding to the significant bits of the current frame image data nFi and of the post driving status data of the previous frame (n−1)Fp, are stored, and the read out compensation values from the table 4*b* are interpolated by the interpolation operation section 4*d* according to the significant bits of the current frame image data nFi and of the post driving status data of the previous frame (n−1)Fp. Because of this, the input image data conversion section 4*a* separates the 8-bit input image data nFi and the 8-bit post driving status data of the previous frame (n−1) Fp into significant 4-bits and insignificant 2-bits respectively, and supplies them to the compensation conversion table 4*b* and the interpolation computing unit 4*d* respectively. The remaining least significant 2-bits are ignored in the interpolation operation in the case of the following example, but all of the insignificant 4-bits may be used for the interpolation operation. In the computing unit 4*c*, the compensation value H, determined by the interpolation operation, is added to the current frame image data nFi, and the display driving data nFo=nFi+H is supplied to the source driver 3. Digital data exists up to this point, and this digital data is D/A converted by the source driver 3 and is supplied to the display panel 1 as analog display driving signals Vd.

In the compensation conversion table 4*b*, the display driving data nFo, where the compensation value H is added to the current frame display data nFi, may be stored instead of the compensation value H. However, in this case, the data capacity of the conversion table 4*b* becomes large, since the display driving data nFo is 8-bit data. On the other hand, the compensation value H can be a small value, that is data with less bits, so the data capacity of the conversion table 4*b* including the compensation value can be decreased. As a consequence, the following embodiments will be described using an example where the compensation values H are stored in the conversion table 4*b*, and the compensation value H is added to the current frame image data nFi by the computing unit 4*c*. The post driving status data generation section 4*x* generates the post driving status data of the current frame nFp from the current frame image data nFi and the post driving status data of the previous frame (n−1)Fp. This post driving status data generation is described in detail in the above mentioned Japanese Patent Application Laid-Open No. 2002-297104.

Figure 3:
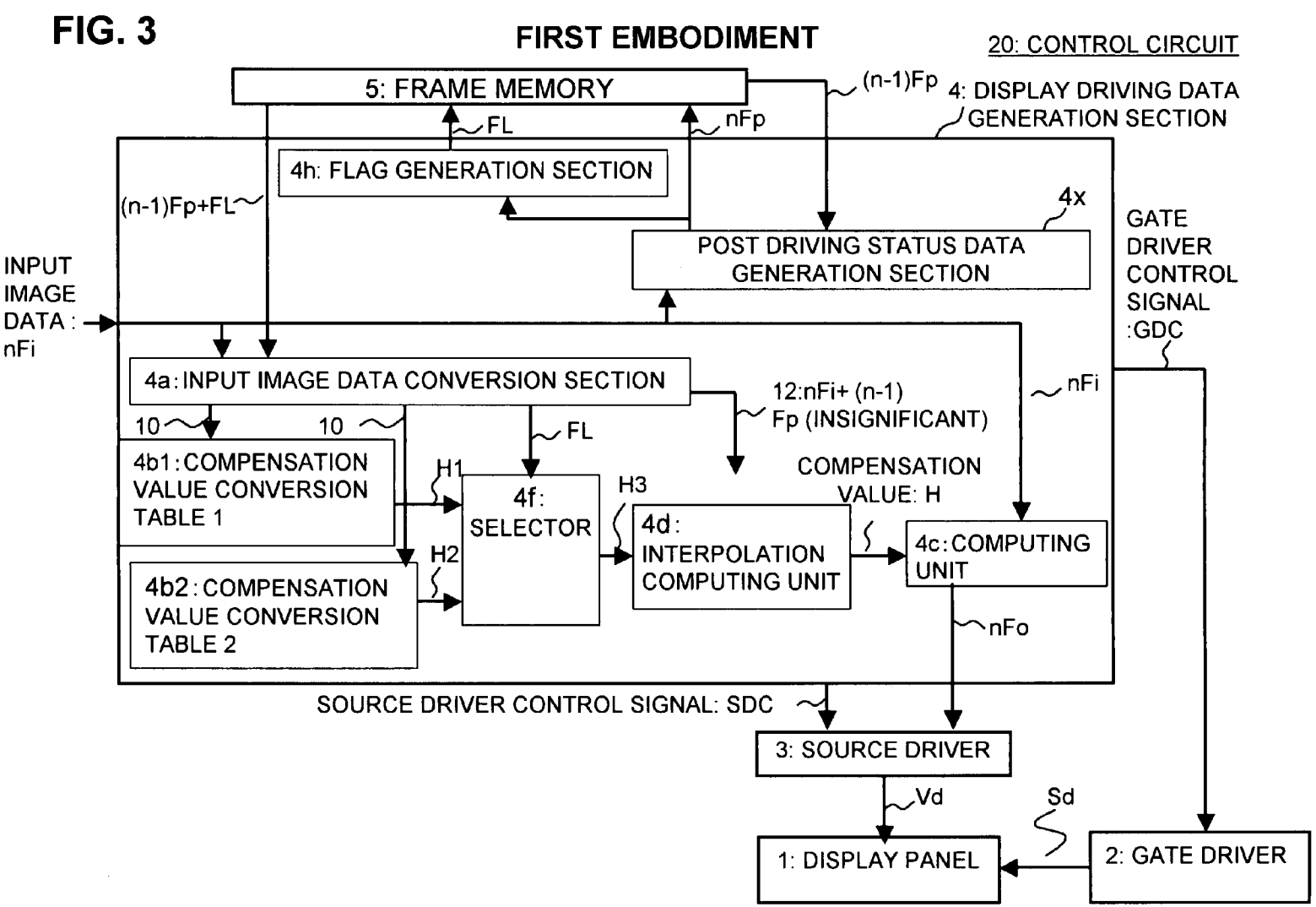
FIG. 3 is a block diagram depicting the liquid crystal display device according to the first embodiment.

FIG. 3 is a block diagram depicting the liquid crystal display device according to the first embodiment. In comparison with the block diagram in FIG. 2, the first embodiment will be described. At first, the compensation conversion table is comprised of the first compensation conversion table 4*b*1, which is used when the post driving status data of the previous frame (n−1)Fp is gray scale "0", and the second compensation conversion table 4*b*2, which is used when other than gray scale "0". In the frame memory 5, the singular point flag FL, which is generated by the flag generation section 4*h* when the post driving status data nFp is gray scale "0", is stored, in addition to the post driving status data nFp. In the present embodiment, the significant 4-bits of the 8-bit (256 gray scales) post driving status data nFp and only the insignificant 2-bits thereof are stored, and the least significant 2-bits are not stored, therefore the singular point flag FL for indicating whether the gray scale is "0" is generated and stored in the flame memory 5.

FIG. 4 are tables showing examples of compensation value conversion tables. In each conversion table, compensation values H are stored according to the combination of the post driving status data of the previous frame (start point gray scale) (n−1)Fp and the current frame image data (end point gray scale) nFi. A value in a cell is the compensation value H. As described above, these tables correspond to the significant 4-bits of the post driving status data of the previous frame (start point gray scale) (n−1)Fp and the current frame image data (end point gray scale) nFi, so compensation values are stored corresponding to the 17 gray scales respectively.

FIG. 4A corresponds to a conventional compensation conversion table 4*b*, where 17×17=289 compensation values are stored, corresponding to the post driving status data of the previous frame (start point gray scale) (n−1)Fp and the current frame image data (end point gray scale) nFi, that is, 17 gray scales respectively. The data capacity can be decreased compared with storing the 256×256 compensation values corresponding to all the 256 gray scales.

Figure 1:
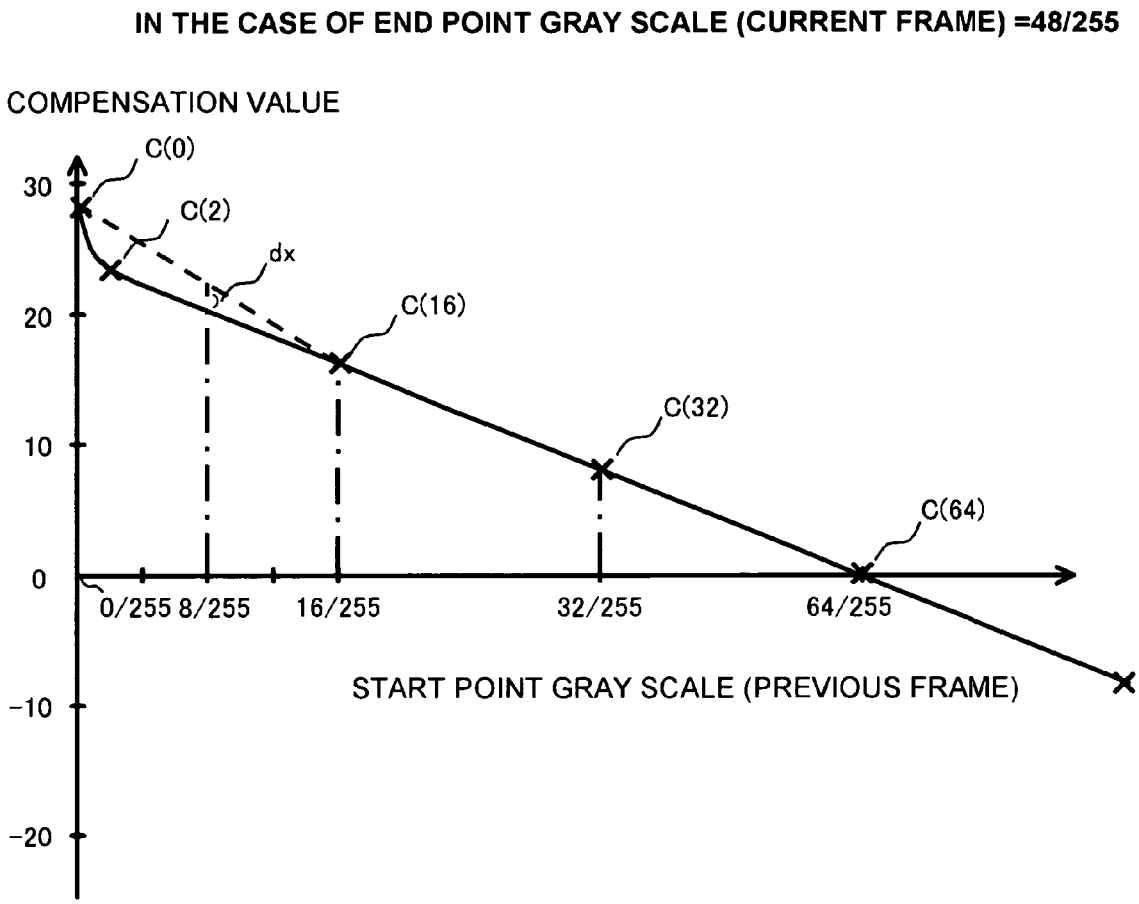
FIG. 1 is a graph depicting the post driving status of the previous frame and the compensation value.

FIG. 1 shows the compensation values corresponding to the end gray scale when the end point gray scale of this table is in the 48/255 column. As described for FIG. 1, the portion between the start point gray scale "0" and "16" does not indicate linear characteristics, so if the compensation value corresponding to the start point gray scale "0" is used, then inappropriate compensation values are acquired in the interpolation operation. Therefore in the first embodiment, the table, where the post driving status data of the previous frame (start point gray scale) (n−1)Fp is "0", is created as the singular point conversion table 4*b*1. And the ordinary point conversion table 4*b*2, which is referred to when the post driving status data of the previous frame (start point gray scale) (n−1)Fp is a gray scale other than "0", is created separately.

FIG. 4B is an example of the ordinary point table 4*b*2. In this example, when the post driving status data of the previous frame (start point gray scale) (n−1)Fp is "2", "16", "32", "48" . . . "255", 17 compensation values corresponding to 17 current frame image data (end point gray scale) nFi exist respectively. FIG. 4C is an example of the singular point table 4*b*1, and in this example, only when the post driving status data of the previous frame (start point gray scale) (n−1)Fp is "0", 17 compensation values corresponding to 17 current frame image data (end point gray scale) nFi exist.

FIG. 5 are graphs showing the ordinary point conversion table 4*b*2 in FIG. 4B and the singular point conversion table 4*b*1 in FIG. 4C. These are the graphs which are converted from the tables in FIG. 4. In FIG. 5, the abscissa shows the 17 points of the end gray scale which is the current frame image data nFi, and the ordinate show the compensation value data. The ordinary point conversion table 4*b*2 shows the compensation value graph for 17 start point gray scales 2/255, 16/255–255/255. The singular point conversion table 4*b*1 shows the compensation value graph for one start point gray scale 0/255.

In FIG. 3, the input image data conversion section 4*a* supplies the significant 4-bits of the image data of the current frame (end point gray scale) nFi and the post driving status data of the previous frame (start point gray scale) (n−1)Fp to the first compensation value conversion table 4*b*1 for singular points and the second compensation value conversion table 4*b*2 for ordinary points, as input addresses 10. In response to this, the ordinary point conversion table 4*b*2 outputs the compensation value of the cell corresponding to the input address and the compensation values of the three cells with higher gray scales adjacent to the cell corresponding to the input address, a total of four compensation values H2. The singular point conversion table 4*b*1, on the other hand, outputs the compensation value of the cell corresponding to the input address, and the compensation value of the cell with the higher gray scale adjacent to the cell corresponding to the input address a total of two compensation values H1. In the singular point conversion table 4*b*1, only the compensation values when the post driving status data of the previous frame (end point gray scale) is "0" is stored, so compensation values are not output unless the post driving status data of the previous frame at the input address 10 is gray scale "0".

The selector 4*f* selects the compensation value H1 or H2 according to the flag FL in the frame memory 5, and outputs the selected compensation value H to the interpolation computing unit 4*d*. In other words, if the flag FL indicates that the post driving status data of the previous frame (start point gray scale) (n−1)Fp is "0", then the compensation value H1 is selected, and if not "0", the compensation value H2 is selected.

The interpolation computing unit 4*d* interpolates the compensation value H3 selected by the selector based on the insignificant bits of the image data of the current frame (end point gray scale) nFi and the post driving status of the previous frame (start point gray scale) (n−1) Fp, shown as the input 12 and determines the compensation value H. For the interpolation operation, linear interpolation is executed since the compensation value H3 has roughly linear characteristics, except for the gray scale "0" of the singular point, as shown in FIG. 1.

The ordinary point conversion table 4*b*2 outputs four compensation values. In the case of the example in FIG. 4B, where the start gray scale corresponding to the significant bit 10 is 16/255and the end point gray scale corresponding to the significant bit 10 is 48/255, the compensation value "17" and the compensation values of the adjacent start point gray scale 32/255and the end point gray scale 64/255, that is "9", "24" and "16" are read. Weighted interpolation is performed on these four compensation values based on the insignificant bit 12, and the interpolated compensation value H is determined. As mentioned above, insignificant bit 12 is 2-bits, so one of the interpolation values when the adjacent compensation values are divided into 4 is calculated. Since the insignificant bit 12 is 2-bits, handling of the start point 2/255 is actually the same as the handling of the start point gray scale 0/255 in the interpolation operation. Therefore according to the characteristics in FIG. 1, the minimum start point gray scale of the ordinary point conversion table 4b2 may be either 1/255 or 3/255, depending on the characteristics in FIG. 1. If the insignificant bit 12 is 4-bits, the interpolation computing unit 4*d* calculates one of the interpolation values among 16 divided adjacent interpolation values.

From the singular point table 4*b*1, on the other hand, two compensation values for the start point gray scale 0/255 are read, so the interpolation computing unit 4*d* performs weighted interpolation operation by insignificant bits of the end point gray scale for the two compensation values, and determines interpolated compensation value H. In the present embodiment, the singular point conversion table 4*b*1 stores only the compensation values for the start point gray scale 0/255, but may store the compensation values for the start point gray scales 4/255, 8/255 and 12/255 respectively. In this case, the minimum start point gray scale of the ordinary point conversion table 4b2 becomes 16/255. In other words, the singular point conversion table is referred to for the start point gray scales 0–16, and the ordinary point conversion table is referred to for the start point gray scales 16–255. In the case of the compensation values from the singular point conversion table, the interpolation operation is performed for the end point gray scale, and in the case of the compensation values from the ordinary point conversion table, the interpolation operation is performed for both the start point gray scale and the end point gray scale.

The computing unit 4*c* adds the compensation value H, determined by the interpolation operation, to the image data nFi of the current frame, to calculate the display driving data nFo, and supplies the display driving data nFo to the source driver 3. The source driver 3 generates the analog display driving signal Vd corresponding to this display driving data nFo, and supplies it to the display panel 1.

In the first embodiment, the compensation value conversion table, for singular points of which the characteristics differ from remaining points, is created separately from the compensation value conversion table for ordinary points, so that the compensation values are read from the singular point conversion table if the post driving status data of the previous frame corresponds to the singular point, therefore a more accurate compensation value can be calculated. In the compensation value conversion table, the display driving data, where the compensation value is added to the image data of the current frame, may be stored.

Figure 6:
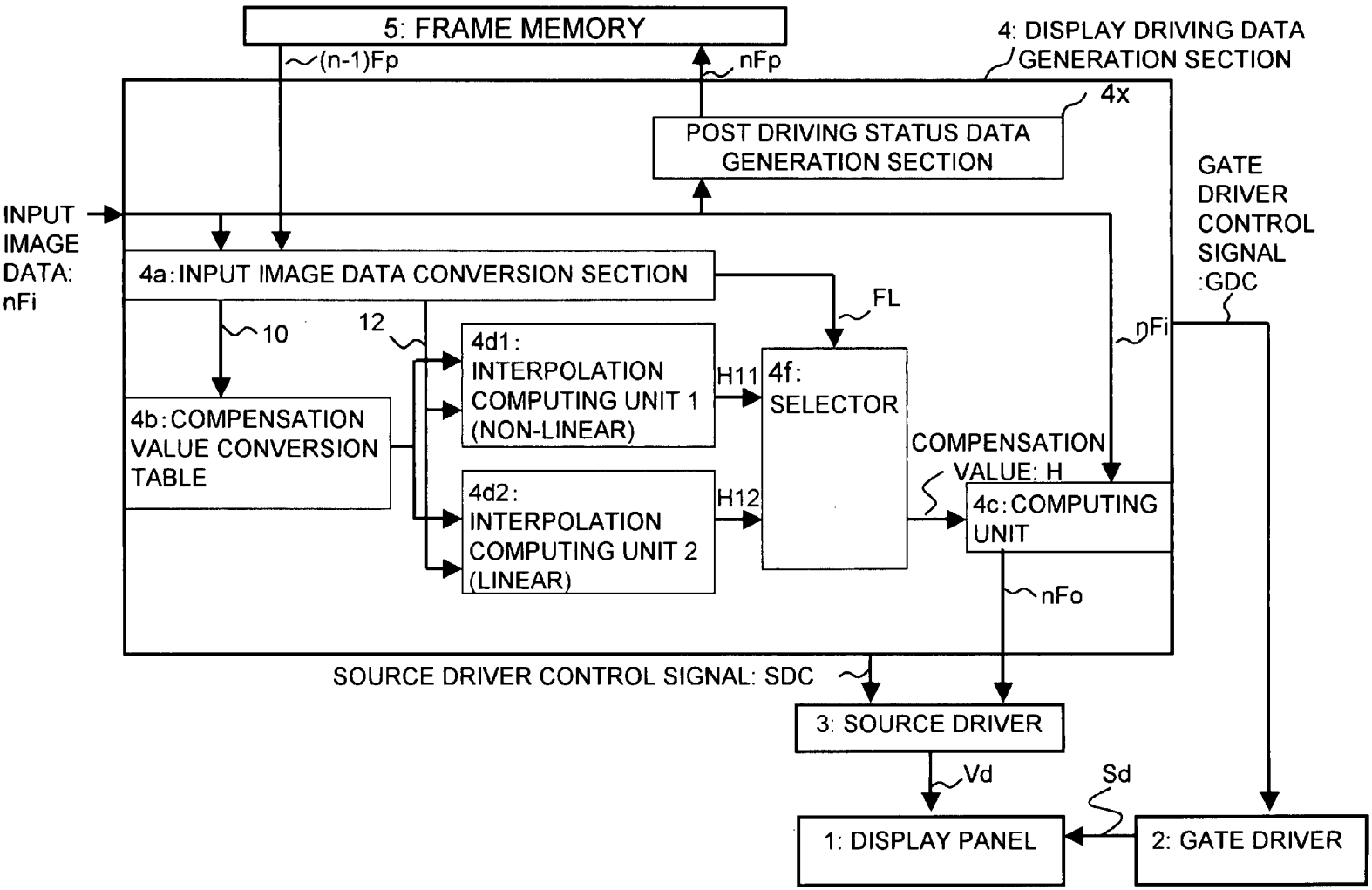
FIG. 6 is a block diagram depicting the liquid crystal display device according to the second embodiment.

FIG. 6 is a block diagram depicting the liquid crystal display device according to the second embodiment. The difference of this configuration from that in FIG. 2 is that the interpolation computing unit comprises a first interpolation computing unit 4*d*1 which performs the interpolation operation of the compensation values including the singular points, and a second interpolation computing unit 4*d*2 which performs the interpolation operation of the compensation values of ordinary points, and the selector 4*f* selects one of the compensation values H1 and H2 determined by the respective interpolation computing units 4*d*1 and 4*d*2, based on the singular point flag FL. In this example, the flag generation section is not disposed, but all of the 8-bit post driving status data is stored in the frame memory 5, therefore the input image data conversion section 4*a* can generate the flag FL by judging whether the point of (n−1)Fp is a singular point or not, based on the 8-bit post driving status data of the previous frame (n−1)Fp.

As FIG. 1 shows, the compensation values have non-linear characteristics between the starting point gray scales 0/255 and 16/255, but have linear characteristics between the start point gray scales 16/255 and 255/255. Therefore in the second embodiment, the interpolation operation is a non-linear interpolation if the post driving status data of the previous frame (start point gray scale) (n−1)Fp is the singular point 0/255, and is linear interpolation if it is an ordinary point, other than a singular point.

FIG. 7 shows examples of two interpolation operations in the second embodiment. FIG. 7A indicates the interpolation formula of the interpolation computing unit 4*d*2 for ordinary points, and FIG. 7B indicates the interpolation formula of the interpolation computing unit 4*d*1 for singular points. In the case of an ordinary point, both the start point gray scale range (vertical direction of FIG. 7A) and the end point gray scale range (horizontal direction of FIG. 7A) are equally divided and interpolated (linear interpolation), but in the case of a singular point, the start point gray scale range (vertical direction of FIG. 7B) is unequally divided and interpolated (non-linear interpolation), and the end point gray scale range (horizontal direction of FIG. 7B) is equally divided and interpolated. In the case of unequal division interpolation, the interpolation operation is performed at 4:2:1:1 in the start point gray scale direction (vertical direction). In other words, the portion between the singular point 0/255 and the adjacent gray scale point 16/255 has downward convex characteristics, so by performing the above mentioned non-linear interpolation at 4:2:1:1, accurate compensation values corresponding to the characteristics can be interpolated.

Figure 8:
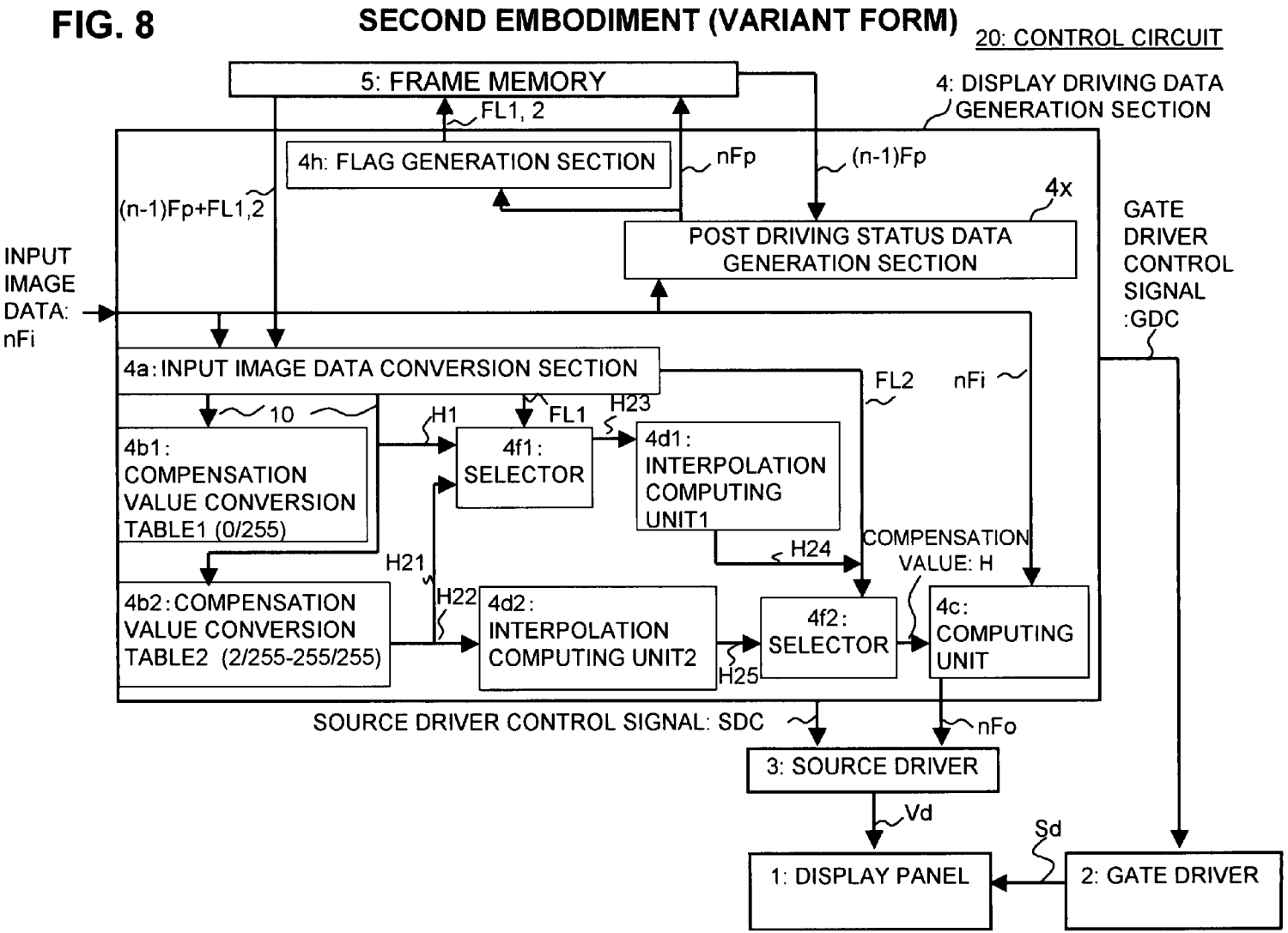
FIG. 8 is a block diagram depicting the liquid crystal display device according to a modification of the second embodiment.

FIG. 8 is a block diagram depicting the liquid crystal display device according to a modification of the second embodiment. In this example, two interpolation computing units 4*d*1 and 4*d*2 are provided, just like the configuration in FIG. 6, and the compensation value conversion table is divided into the table for singular points 4*b*1 and the table for ordinary points 4*b*2. And the compensation values at two points, read from the compensation value table for singular points 4*b*1, are interpolated by the interpolation computing unit 4*d*1, and the interpolation operation for the compensation values at four points, read from the compensation value table for ordinary points 4*b*2, is performed by the first interpolation computing unit 4*d*1 if the start point gray scale is in the 2/255 to 16/255 range, and by the second interpolation computing unit 4*d*2 if the start point gray scale is 16/255 or more. Just like the case of FIG. 6, the interpolation computing unit 4*d*1 performs a non-linear interpolation operation for the start point gray scale range, and a linear interpolation operation for the end point gray scale range, and the interpolation computing unit 4*d*2 performs a linear interpolation operation for both cases.

Along with this, the flag generation section 4*h* generates the first flag FL1 used when the post driving status data nFp is "0", and the second flag FL2 used when the post driving status data nFp is "0"–"16", and stores both in the frame memory 5. And the selector 4*f*1 selects either the compensation value H1 or H21 according to the first flag FL1. The selector 4f2 selects either the compensation value H24 or H25 according to the second flag FL2.

According to the above configuration, if the post driving status data of the previous frame (n−1)Fp is 0/255, the compensation value H1 of the first compensation value conversion table 4*b*1 is read, the interpolation computing unit 4*d*1 performs a linear interpolation operation for the end point gray scale range, and supplies it to the computing unit 4*c* as the compensation value H. If the post driving status data of the previous frame (n−1)Fp is 2/255–16/255, on the other hand, the compensation value H21 of the second compensation value conversion table 4*b*2 is read, and the interpolation computing unit 4*d*1 performs a non-linear interpolation operation for the start point gray scale range, and a linear interpolation operation for the end point gray scale range. If the post driving status data of the previous frame (n−1) Fp is 16/255–255/255, the compensation value H22 of the second compensation value conversion table 4*b*2 is read, and the interpolation computing unit 4*d*2 performs a linear interpolation operation for the start point gray scale range and the end point gray scale range.

Figure 9:
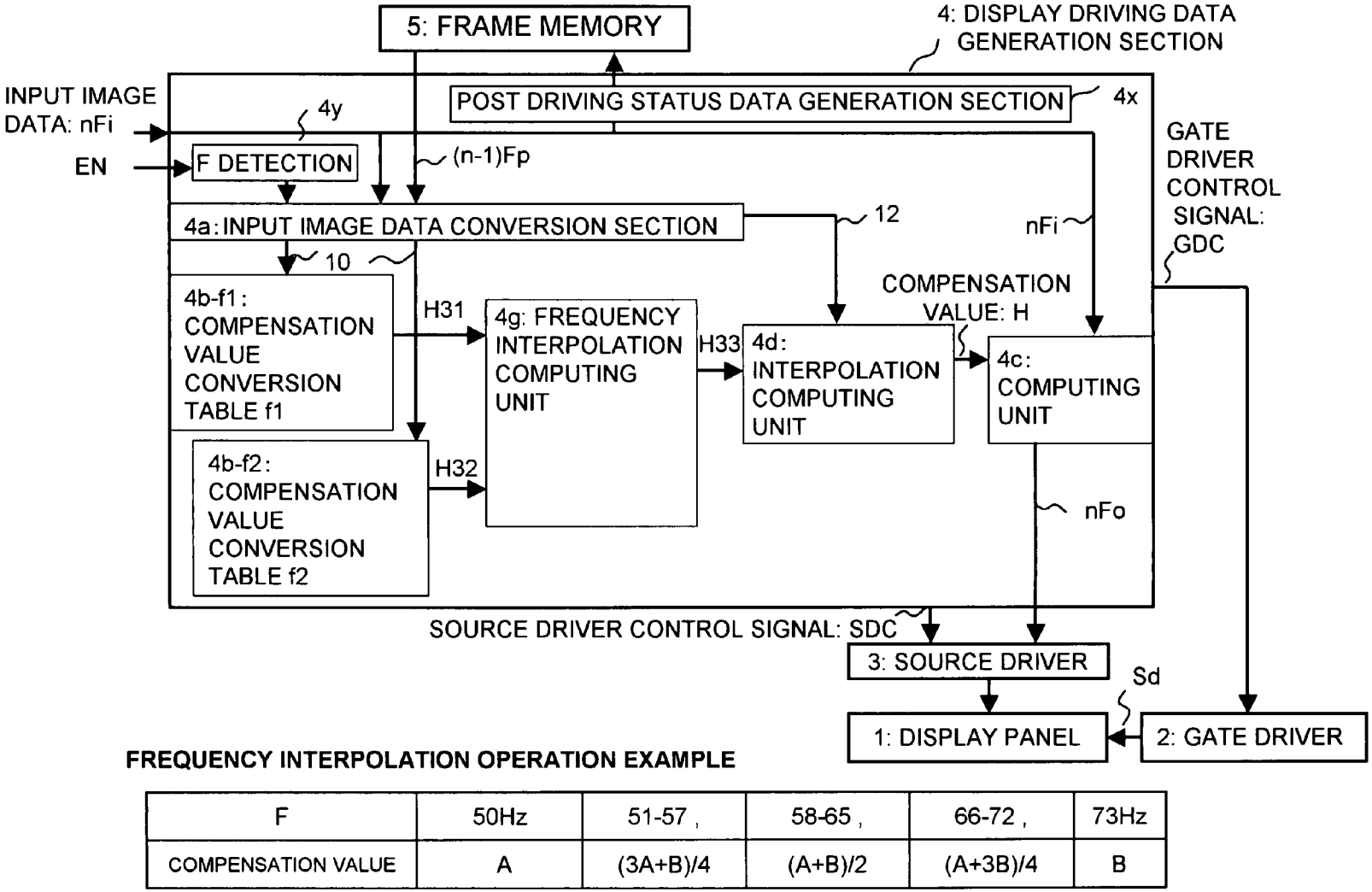
FIG. 9 is a block diagram depicting the liquid crystal display device according to the third embodiment.

FIG. 9 is a block diagram depicting the liquid crystal display device according to the third embodiment. If any frequency can be selected in the host computer which supplies the image data to the liquid crystal display device, the frame frequency or the frame period changes accordingly. Since the driving compensation is a driving system to add the compensation value to the image data in order to compensate for each pixel to become the status of the input image data within the frame period, it is demanded that as the frame period increases, the compensation value can be decreased, and as the frame period decreases the compensation value can be increased.

Therefore in the third embodiment, the compensation value conversion table is comprised of a first compensation value conversion table 4*b*-*f*1 for storing the compensation value used for the first frequency, and a second compensation value conversion table 4*b*-*f*2 for storing the compensation values used for the second frequency, and according to the frequency F which the frame frequency detection section 4*y* detected, the frequency interpolation computing unit 4*g* interpolates the compensation values inside or outside the two compensation values H31 and H32. Strictly speaking, compensation values outside the first and second frequencies are extrapolated.

FIG. 9 shows an example of the frequency interpolation operation. When the first frequency is 50 Hz and the second frequency is 73 Hz, the frame frequency detection section 4*y* divides the range between these two frequencies into 4, and detects three types of frequencies. And from the compensation value A in the first compensation value conversion table 4*b*-*f*1, the compensation value B in the second compensation value conversion table 4*b*-*f*2 and the detected frequency F, the frequency interpolation computing unit 4*g* determines the compensation value H33 corresponding to the detected frequency using a linear interpolation. In the third embodiment as well, the interpolation computing unit 4*d* performs an interpolation operation using the insignificant bit 12. Therefore the compensation values H31 and H32 are the compensation values at four points. The frequency interpolation computing unit 4*g* and the interpolation computing unit 4*d* may be reversed in sequence.

As described above, more appropriate compensation values can be interpolated by creating a separate compensation value conversion table or by using a different interpolation computing unit for singular points of which the characteristics of the compensation values are different from ordinary points. Also by creating a compensation value conversion table corresponding to minimum and maximum frame frequencies, more appropriate compensation values can be interpolated according to different frame frequencies.

In the above embodiment, the gray scale values of the previous frame are used as the post driving status data (n−1)Fp, but if the post driving status data generation section 4*x* is not disposed, the gray scale value of the previous frame can be used as the image data of the previous frame (n−1)Fi, regarding that the cell was driven to the status of the input image data nFi by compensation driving. However, the compensation values may not be appropriate in the case when the post driving status does not become exactly as the image data.

According to the present invention, more appropriate compensation values or compensation display driving data can be generated.

What is claimed is:

1. A control circuit of a liquid crystal display device, comprising:

a display driving data generation section for generating display driving data corresponding to a combination of image data of a current frame and post driving status data of a previous frame, wherein said display driving data generation section further comprises:

a conversion table for storing compensation data or compensation display driving data corresponding to a combination of significant bits of the image data of the current frame and of the post driving status data of the previous frame; and an interpolation operation section for generating interpolation compensation data or interpolation compensation display driving data by performing an interpolation operation for the compensation data or the compensation display driving data which is read from said conversion table according to insignificant bits of said image data of the current frame and of the post driving status data of the previous frame, said conversion table including a singular point conversion table used when the post driving status data of the previous frame is a first data, and an ordinary point conversion table used when the post driving status data of the previous frame is other than said first data, and said display driving data generation section selecting either said singular point conversion table or said ordinary point conversion table depending on whether the post driving status data of the previous frame is the first data.

2. The control circuit of a liquid crystal display device according to claim 1, further comprising a frame memory for storing said post driving status data, wherein a flag for indicating whether said post driving status data is the first data or not is stored in said frame memory, and said singular point conversion table or said ordinary point conversion table is selected according to said flag.

3. The control circuit of a liquid crystal display device according to claim 1, wherein two adjacent compensation data or compensation display driving data corresponding to the significant bits of the image data of said current frame are read from said singular point conversion table, and the interpolation operation is performed for the read two data according to the insignificant bits of said image data of the current frame; and four adjacent compensation data or compensation display driving data corresponding to the significant bits of said post driving status data of the previous frame and of the image data of the current frame respectively are read from said ordinary point conversion table, and the interpolation operation is performed for the read four data according to the insignificant bits of said post driving status data of the previous frame and of the image data of the current frame.

4. A control circuit of a liquid crystal display device, comprising:

a display driving data generation section for generating display driving data corresponding to a combination of image data of a current frame and post driving status data of a previous frame, wherein said display driving data generation section further comprises:

a conversion table for storing compensation data or compensation display driving data corresponding to a combination of the significant bits of the image data of the current frame and of the post driving status data of the previous frame; and an interpolation operation section for generating interpolation compensation data or interpolation compensation display driving data by performing an interpolation operation for compensation data or compensation display driving data which is read from said conversion table according to insignificant bits of said image data of the current frame and of said post driving status data of the previous frame, said interpolation operation section including a singular point interpolation operation unit used when the post driving status data of the previous frame is a first data and an ordinary point interpolation operation unit used when the post driving status data of the previous frame is other than said first data, and said display driving data generation section selecting either said singular point interpolation operation unit or said ordinary point interpolation operation unit depending on whether the post driving status data of the previous frame is the first data or not.

5. The control circuit of a liquid crystal display device according to claim 4, further comprising a frame memory for storing said post driving status data, wherein a flag for indicating whether said post driving status data is the first data or not is stored in said frame memory, and said singular point interpolation operation unit or said ordinary point interpolation operation unit is selected according to said flag.

6. The control circuit of a liquid crystal display device according to claim 4, wherein said singular point interpolation operation unit performs a non-linear interpolation operation for said post driving status data of the previous frame, and said ordinary point interpolation operation unit performs a linear interpolation operation for said post driving status data of the previous frame.

7. The control circuit of a liquid crystal display device according to claim 4, wherein said conversion table further includes a singular point conversion table used when the post driving status data of the previous frame is a second data, and an ordinary point conversion table used when the post driving status data of the previous frame is other than said second data, and said display driving data generation section selects either said singular point conversion table or said ordinary point conversion table according to whether the post driving status data of the previous frame is the second data or not.

8. A control circuit of a liquid crystal display device, comprising:

a display driving data generation section for generating display driving data corresponding to a combination of image data of a current frame and post driving status data of a previous frame, wherein said display driving data generation section further comprises:

a conversion table for storing compensation data or compensation display driving data corresponding to a combination of the image data of the current frame and the post driving status data of the previous frame, said conversion table including a first conversion table corresponding to a first frame frequency and a second conversion table corresponding to a second frame frequency; and an interpolation operation section for performing an interpolation operation which includes an extrapolation operation for compensation data or compensation display driving data which is read from said first or second conversion table according to the current frame frequency, to generate interpolation compensation data or interpolation compensation display driving data.

9. The control circuit of a liquid crystal display device according to claim 8, further comprising a frame frequency detection section for detecting a current frame frequency.

10. A liquid crystal display device comprising:

a liquid crystal display panel; and a control circuit of the liquid crystal panel, including a display driving data generation section for generating display driving data corresponding to a combination of image data of a current frame and post driving status data of a previous frame, wherein said display driving data generation section further comprises:

a conversion table for storing compensation data or compensation display driving data corresponding to a combination of significant bits of the image data of the current frame and of the post driving status data of the previous frame; and an interpolation operation section for generating interpolation compensation data or interpolation compensation display driving data by performing an interpolation operation for the compensation data or the compensation display driving data which is read from said conversion table according to insignificant bits of said image data of the current frame and of the post driving status data of the previous frame, said conversion table including a singular point conversion table used when the post driving status data of the previous frame is a first data, and an ordinary point conversion table used when the post driving status data of the previous frame is other than said first data, and said display driving data generation section selecting either said singular point conversion table or said ordinary point conversion table depending on whether the post driving status data of the previous frame is the first data.

11. A liquid crystal display device comprising:

a liquid crystal display panel; and a control circuit of the liquid crystal panel, including a display driving data generation section for generating display driving data corresponding to a combination of image data of a current frame and post driving status data of a previous frame, wherein said display driving data generation section further comprises:

a conversion table for storing compensation data or compensation display driving data corresponding to a combination of the significant bits of the image data of the current frame and of the post driving status data of the previous frame; and an interpolation operation section for generating interpolation compensation data or interpolation compensation display driving data by performing an interpolation operation for compensation data or compensation display driving data which is read from said conversion table according to insignificant bits of said image data of the current frame and of said post driving status data of the previous frame, said interpolation operation section including a singular point interpolation operation unit used when the post driving status data of the previous frame is a first data and an ordinary point interpolation operation unit used when the post driving status data of the previous frame is other than said first data, and said display driving data generation section selecting either said singular point interpolation operation unit or said ordinary point interpolation operation unit depending on whether the post driving status data of the previous frame is the first data or not.

12. A liquid crystal display device comprising:

a liquid crystal display panel; and a control circuit of the liquid crystal panel, including a display driving data generation section for generating display driving data corresponding to a combination of image data of a current frame and post driving status data of a previous frame, wherein said display driving data generation section further comprises:

a conversion table for storing compensation data or compensation display driving data corresponding to a combination of the image data of the current frame and the post driving status data of the previous frame, said conversion table including a first conversion table corresponding to a first frame frequency and a second conversion table corresponding to a second frame frequency; and an interpolation operation section for performing an interpolation operation which includes an extrapolation operation for compensation data or compensation display driving data which is read from said first or second conversion table according to the current frame frequency, to generate interpolation compensation data or interpolation compensation display driving data.

* * * * *